US005782150A

United States Patent [19]

Huang

[11] Patent Number: 5,782,150

[45] Date of Patent: Jul. 21, 1998

[54] SCREW DRIVER HANDLE

[76] Inventor: Yung Hsu Huang, No. 10, Lane 38, Li Der Street, Taiping City, Taichung Hsien, Taiwan

[21] Appl. No.: 802,092

[22] Filed: Feb. 19, 1997

[51] Int. Cl.[6] ..... B25B 23/16; B25G 1/08

[52] U.S. Cl. ..... 81/177.4; 81/490; 206/378; 206/234; 220/4.22; 220/4.23; 220/324; 220/339

[58] Field of Search ..... 81/490, 177.4, 81/437–439; 206/376–379, 234; 220/4.22, 4.23, 342, 337, 339, 324

[56] References Cited

U.S. PATENT DOCUMENTS 5,442,982 8/1995 Bell ..... 81/439

*Primary Examiner*—D. S. Meislin
*Attorney, Agent, or Firm*—Charles E. Baxley, Esq.

[57] ABSTRACT

A tool handle includes a base and a cap pivotally coupled together. The base includes a flange and two punctures and a latch formed in one side edge for engaging with a groove and two projections and an ear of the cap such that the cap may be solidly secured to the base. The base includes a number of holes and the cap includes a number of cavities for partially receiving tool bits and for allowing the tool bits to be easily disengaged from the base. The base includes a chamber and the cap includes a space for engaging with the tool bits.

1 Claim, 2 Drawing Sheets

SCREW DRIVER HANDLE

BACKGROUND OF THE INVENTION

1. Field of the Invention

The present invention relates to a handle, and more particularly to a screw driver handle.

2. Description of the Prior Art

Typical screw driver handles comprise a solid configuration having no space provided for receiving other tool bits therein. In order to improve this, a hollow chamber is formed and provided in the handle for receiving various kinds of screw driver bits. However, in order to find a correct screw driver bit, the user have to pour all of the screw driver bits out of the handle. This is inconvenient.

The present invention has arisen to mitigate and/or obviate the afore-described disadvantages of the conventional screw driver handles.

SUMMARY OF THE INVENTION

The primary objective of the present invention is to provide a screw driver handle which includes various kinds of cavities for receiving various kinds of tool bits and for allowing the tool bits to be easily found.

In accordance with one aspect of the invention, there is provided a tool handle comprising a base and Further objectives and advantages of the present invention will become apparent from a careful reading of a detailed description provided hereinbelow, with appropriate reference to accompanying drawings.

DETAILED DESCRIPTION OF THE PREFERRED EMBODIMENT

A similar screw driver handle is filed in a copending U.S. patent application Ser. No. 08/678,561, filed on Jul. 9, 1996. The co-pending U.S. patent application is taken as a reference of the present invention.

Figure 1:
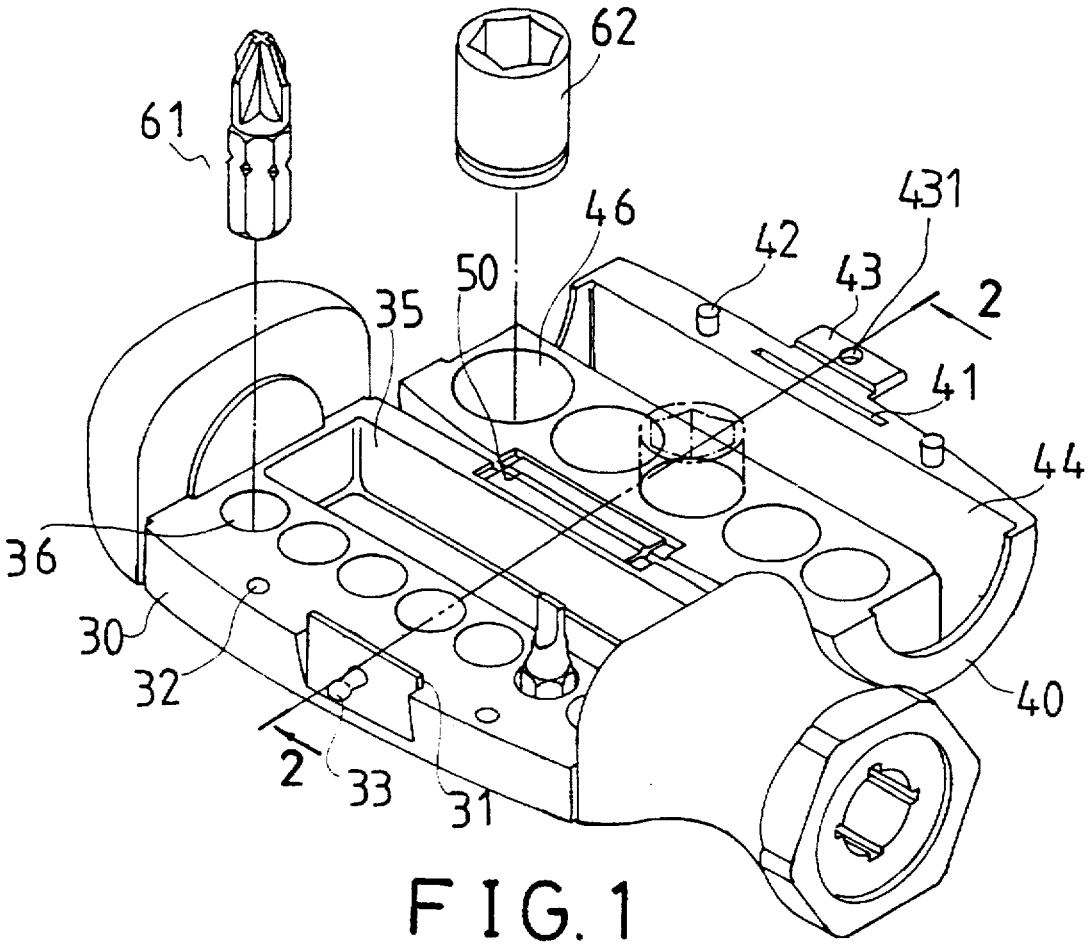
FIG. 1 is a perspective view of a screw driver handle in accordance with the present invention, in which the cap is folded.
Figure 3:
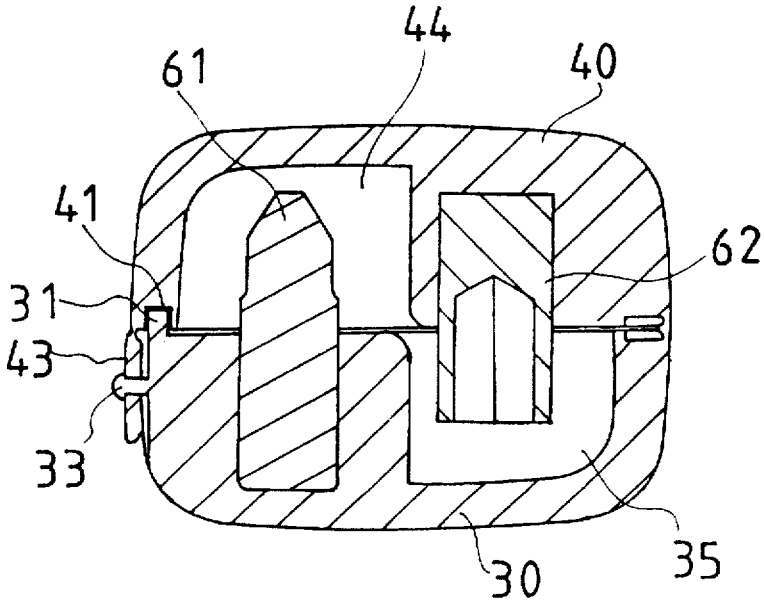
FIGS. 2 and 3 are cross sectional views taken along lines 2—2 of FIG. 1.
Figure 2:
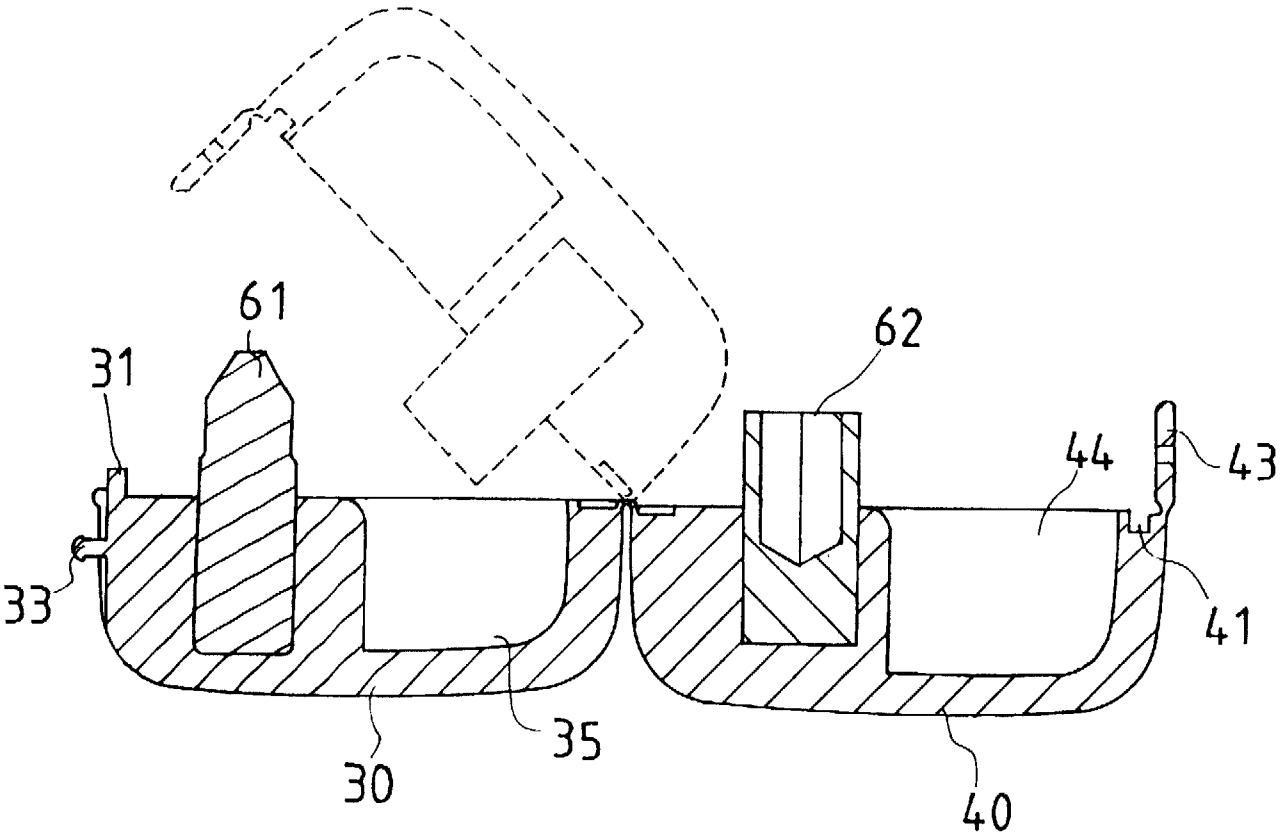

Referring to the drawings, and initially to FIGS. 1 and 2, a screw driver handle in accordance with the present invention comprises a base 30 and a cap 40 pivotally coupled together at a folding line or live hinge 50. The base 30 includes a side edge opposite to the folding line 50 and having a flange 31 extended upward and having two punctures 32. A latch 33 is extended outward from the side edge of the base 30. The cap 40 includes a side edge corresponding to that of the base 30 and opposite to the folding line 50 and having a groove 41 for engaging with the flange 31 (FIG. 3) and having two projections 42 for engaging with the punctures 32 and having an ear 43 which includes an orifice 431 for engaging with the latch 33 (FIG. 3) and for securing the cap 40 to the base 30. The cap 40 may thus be solidly secured to the base 30 by the engagement between the projections 42 and the punctures 32, and by the engagement between the flange 31 and the groove 41, and by the engagement between the latch 33 and the orifice 431 of the ear 43.

The base 30 includes a number of holes 36 of smaller size for partially receiving the screw driver bits 61 and includes a chamber 35. The cap 40 includes a number of cavities 46 of larger size for partially receiving the sockets 62 and includes a space 44. The sockets 62 and the screw driver bits 61 include the lower portion engaged in the cavities 46 and the holes 36 respectively. The upper portions of the sockets 62 and the screw driver bits 61 are extended outward of the cavities 46 and the holes 36 such that the user may easily fetch the sockets 62 and the screw driver bits 61. The upper portions of the sockets 62 and the screw driver bits 61 may be engaged in the chamber 35 and in the space 44 when the cap 40 is secured to the base, best shown in FIG. 3.

It is to be noted that various kinds of sockets and/or screw driver bits and/or other tool bits may be received in the cavities 46 of the cap 40 and/or the holes 36 of the base 30. In addition, the upper portions of the sockets 62 and of the screw driver bits 61 are extended upward beyond the cap 40 and the base 30 such that the sockets 62 and the screw driver bits 61 may be easily disengaged from the cap 40 and the base 30. It is further to be noted that the handle may be used for storing sockets and couplers for wrenches in addition to the screw driver bits.

Accordingly, the handle in accordance with the present invention includes a cap that may be solidly secured to the base and includes a number of cavities and holes formed in the base for receiving various kinds of the tool bits which may be easily disengaged from the base.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool handle comprising:

a base and a cap pivotally coupled together at a folding line, said base including a side edge opposite to said folding line, said side edge of said base including a flange extended upward and including at least one puncture and including a latch extended outward, said base including a plurality of holes for partially receiving tool bits and including a chamber, said cap including a side edge corresponding to that of said base and opposite to said folding line, said side edge of said cap including a groove for engaging with said flange of said base and including at least one projection for engaging with said puncture of said base and including an ear having an orifice for engaging with said latch and for securing said cap to said base and for allowing said cap to be solidly secured to said base, said cap including a plurality of cavities for partially receiving tool bits and for allowing tool bits to be easily disengaged from said base, said cap including a space, said chamber of said base being aligned with said cavities of said cap and said space of said cap being aligned with said holes of said base for engaging with the tool bits when said cap is secured to said base.

* * * * *